United States Patent [19]

Stoffel

[11] 3,994,495

[45] Nov. 30, 1976

[54] TENNIS RACKET

[76] Inventor: Robert W. Stoffel, 1890 Le Tarte, Muskegon, Mich. 49441

[22] Filed: Sept. 22, 1975

[21] Appl. No.: 615,553

[52] U.S. Cl. ..... 273/73 C; 273/73 R; 273/73 D

[51] Int. Cl.[2] ..... A63B 49/02; A63B 51/00

[58] Field of Search ..... 273/73 R, 73 A–73 K, 273/80 R, 80 D, 80 B, 80.1; 73/145; 24/71 CT

[56] References Cited

UNITED STATES PATENTS

| | | | |
|---|---|---|---|
| 1,636,867 | 7/1927 | Robinson | 273/73 K |
| 1,943,066 | 1/1934 | Ford | 273/80 D X |
| 2,032,217 | 2/1936 | Matthews et al. | 73/145 |
| 2,040,194 | 5/1936 | Whiteside | 73/145 |
| 2,395,864 | 3/1946 | Geerlings et al. | 273/73 J |
| 2,463,621 | 3/1949 | Herzog | 273/73 G X |
| 3,083,968 | 4/1963 | Takahashi | 273/73 R |
| 3,833,223 | 9/1974 | Shulkin | 273/80 B X |
| 3,931,968 | 1/1976 | Hedberg | 273/73 J X |

FOREIGN PATENTS OR APPLICATIONS

| | | | |
|---|---|---|---|
| 962,312 | 12/1949 | France | 273/73 K |
| 2,030,998 | 12/1971 | Germany | 273/73 J |
| 23,260 | 10/1908 | United Kingdom | 273/73 D |
| 887,526 | 1/1962 | United Kingdom | 273/73 D |
| 1,209,277 | 10/1970 | United Kingdom | 273/73 G |
| 498,430 | 1/1939 | United Kingdom | 273/73 D |
| 710,625 | 6/1954 | United Kingdom | 273/73 J |

*Primary Examiner*—Richard J. Apley
*Attorney, Agent, or Firm*—Charles W. Chandler

[57] ABSTRACT

A tennis racket having adjustable, resilient means between the handle and the head for reducing arm and elbow shock to the user. The netting is formed by individual lengths of string each having its ends connected to the frame by ferrules. Each string is tensioned in the frame by hand-operated torsion pliers adapted to adjust the tension of the string as it is connected to the frame.

8 Claims, 20 Drawing Figures

A
B
32
12
12
10
14
30
16
22

32
12
12
12
10
14
14
30
30
26
26
16
16
22

TENNIS RACKET

BACKGROUND OF THE INVENTION

This invention relates to tennis rackets and more specifically to a racket having an adjustable resilient means between the netting and the handle, and hand-operated torsion pliers for stringing individual segments of string into the frame to form the netting.

Conventional tennis rackets are so constructed that the user experiences considerable shock to both his arm and his elbow during the course of the game because of the great velocity at which the ball travels. A great amount of energy is required in a short time to change the balls direction of travel. In addition, conventional tennis rackets have a netting formed by stringing a long section of string or gut back and forth in the frame opening which tends to induce kinks because of the long length. When the string breaks, play often must be discontinued to restring the racket unless the user has another racket at his disposal.

A still further problem of conventional tennis rackets is that elaborate apparatus is necessary to evenly tighten the strings that make the netting.

SUMMARY OF THE INVENTION

One of the purposes of the present invention is to provide a tennis racket which is resilient between the handle and the netting with means for selectively adjusting the flexibility so that the netting frame is movable with respect to the handle as it comes in contact with the ball.

One advantage of the preferred racket is the user can adjust the racket to provide less arm and elbow shock. In addition, it is possible to provide more speed on all strokes and better control on service return.

Another object of the invention is to provide a netting formed by individual string sections each of which has its end connected to opposite sides of the frame. Preferrably, a split ferrule is wedged in each string-receiving opening, locking the string in the opening. The advantage of such an arrangement is that the user can continue to use the racket even though a single string should break. In addition, a novel form of the hand-operated torsion instrument is employed for tightening the string to a selected tension. The preferred torsion instrument can be easily operated to quickly replace an individual string at a minimum of cost.

DESCRIPTION OF THE DRAWINGS

The description refers to the accompanying drawings in which like reference characters refer to like parts throughout the several views, and in which.

DESCRIPTION OF THE PREFERRED EMBODIMENTS

Figures 1, 2, 3, 4, 15, 16:
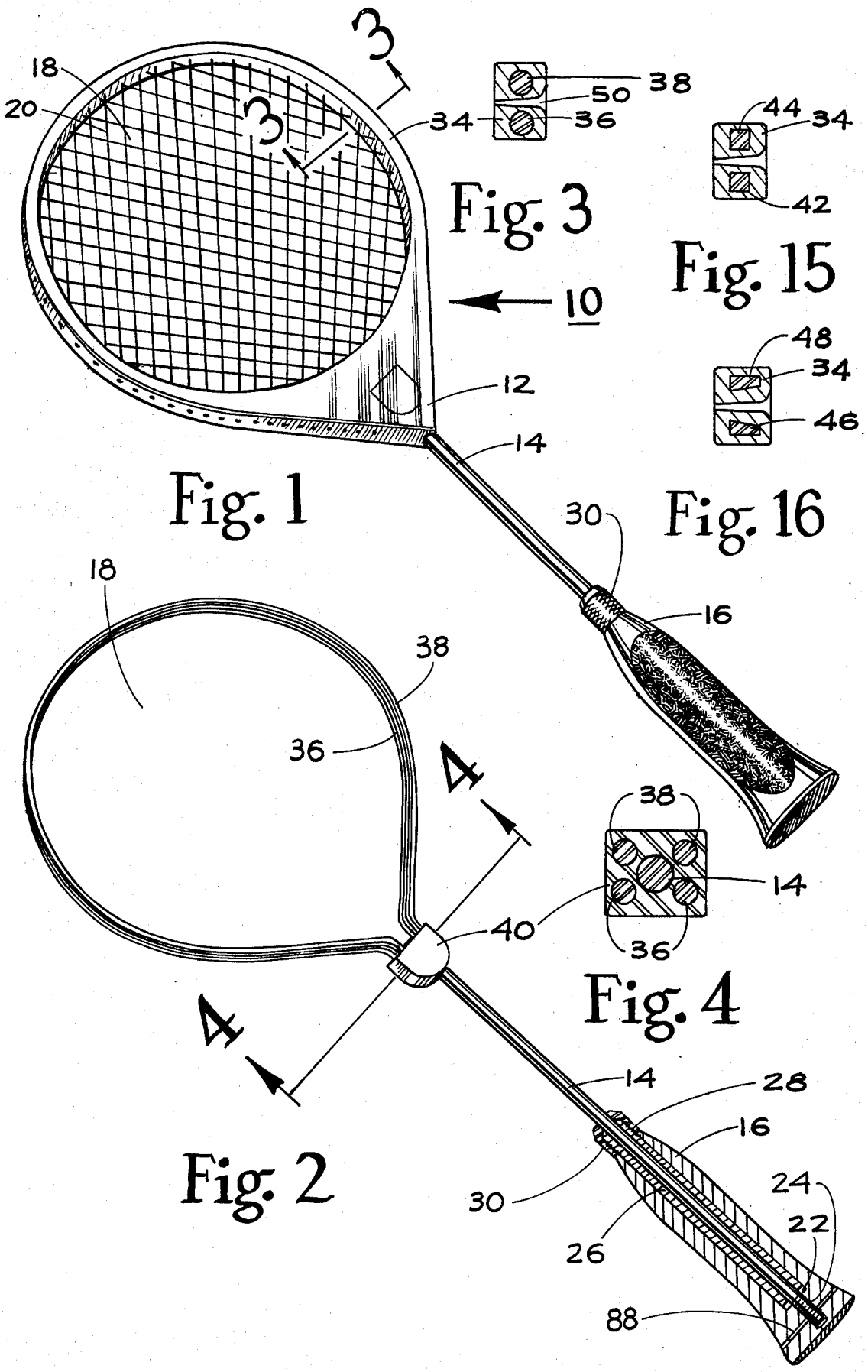
FIG. 1 is a perspective view of a preferred racket made in accordance with the invention.
FIG. 2 is a view similar to FIG. 1, but with portions of the racket removed for clarification.
FIG. 3 is an enlarged sectional view taken along lines 3—3 of FIG. 1.
FIG. 4 is an enlarged sectional view taken along lines 4—4 of FIG. 2.
FIGS. 15 and 16 show other forms of core for the racket frame.

Now referring to the drawings, a preferred tennis racket 10 is illustrated in FIG. 1 as comprising head 12, adjustable shaft means 14, and handle 16. Head 12 has an opening 18 supporting netting 20.

Figure 5:
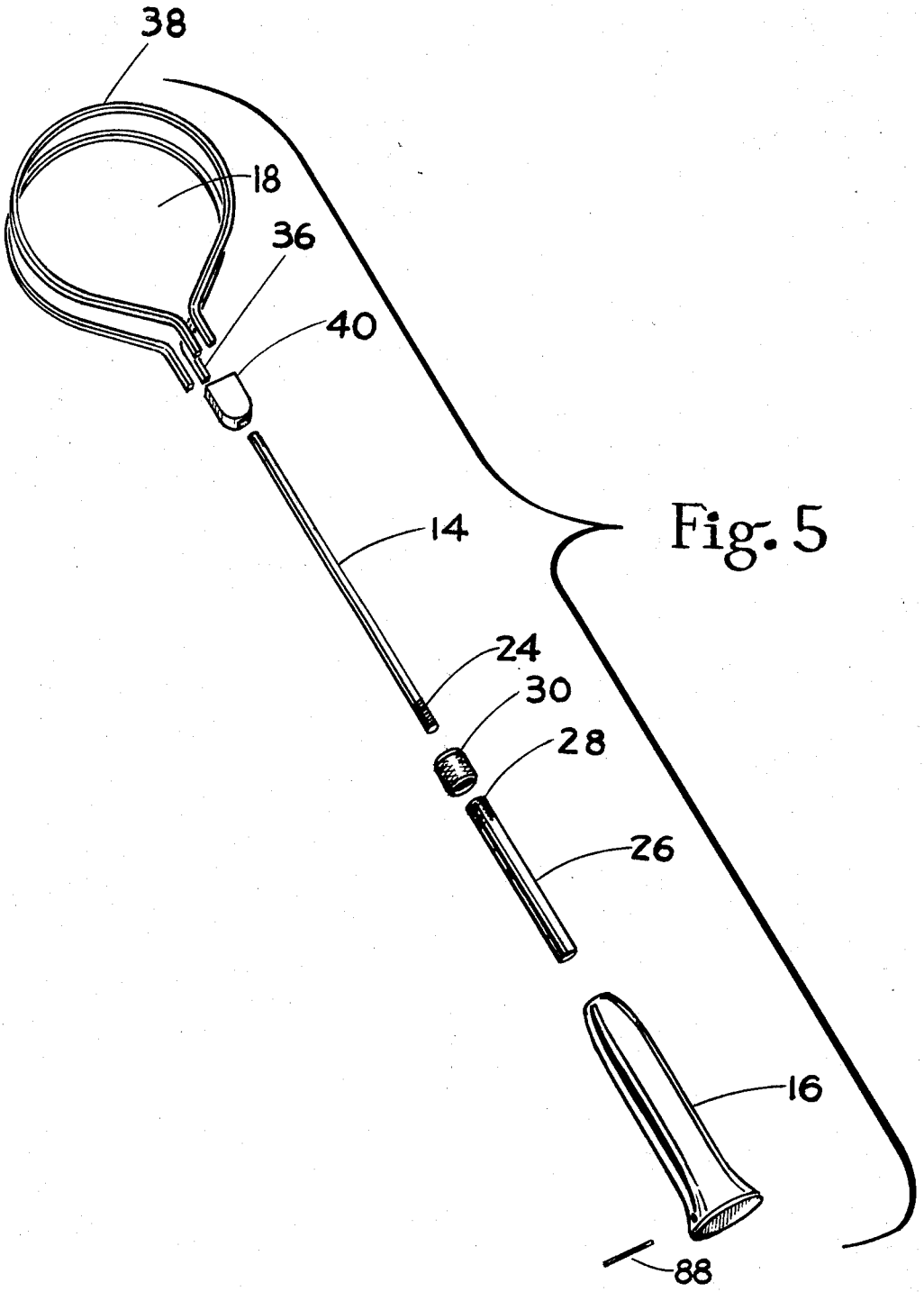
FIG. 5 is an exploded view of the preferred racket with portions of the frame and netting removed for purposes of clarity.

Referring to FIGS. 2 and 5, handle 16 has an opening 22 extending the major portion of the handle's length. Shaft means 14 is threaded at its lower end 24 and screwed and connected by pin 88 to the base of handle 16. Shaft means 14 is relatively flexible to bend and allow head 12 to be moved with respect to handle 16.

An elongated tube 26, threaded and split at one end, is slideably mounted on shaft means 14 and has a length less than that of shaft means 14. Tube 26 forms a relatively snug fit in opening 22 of the handle. The outer end of tube 26 is threaded and split at 28. A collet 30 is threaded on end 28 of tube in such a manner that by manipulating the collet, it can be locked on the shaft at any selected position between head 12 and handle 16.

Figures 6A, 6B, 6C, 7A, 7B, 7C:
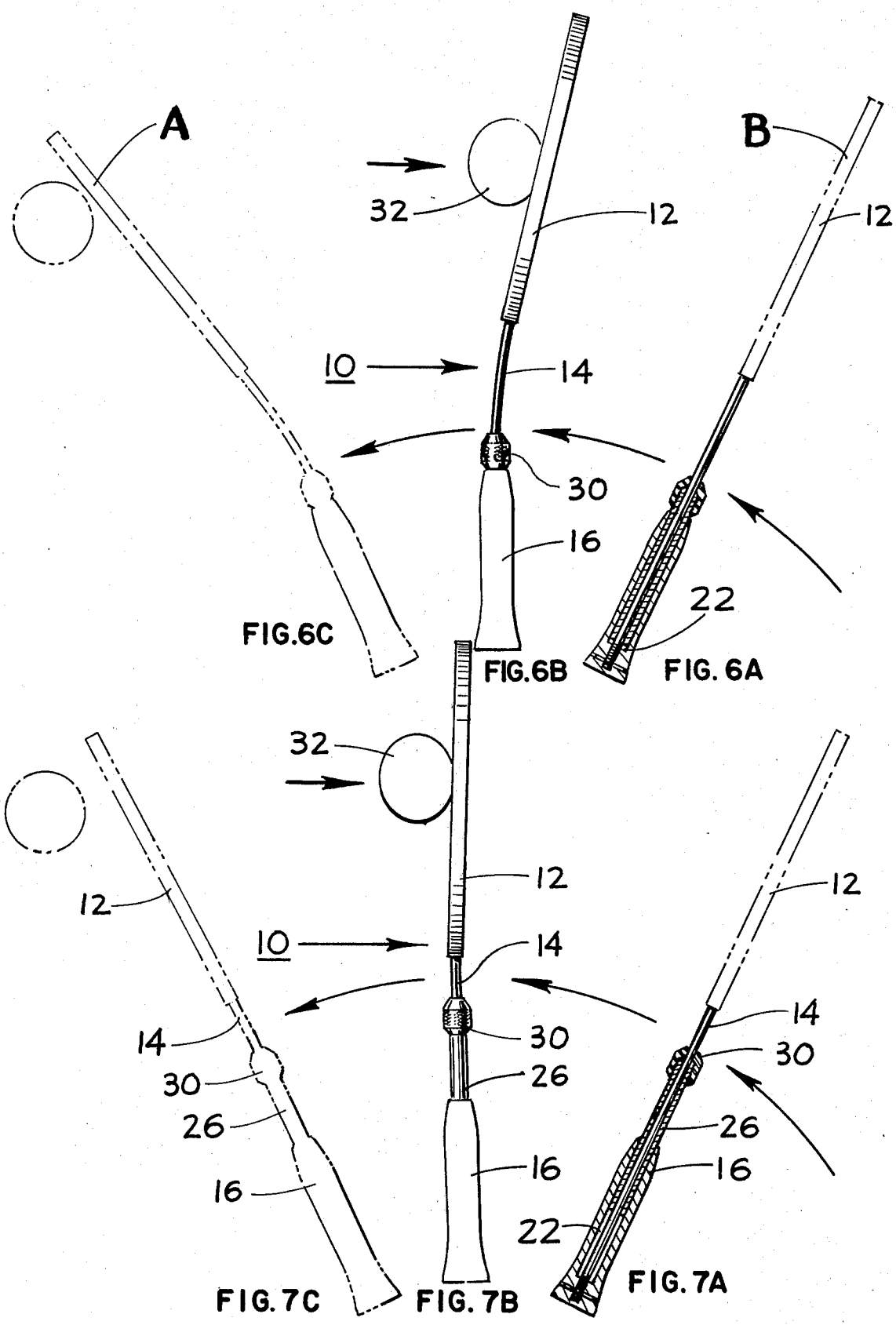
FIGS. 6A to 6C are views of the preferred racket illustrating the motion of the netting frame with respect to the handle when the adjusting tube is adjacent to the handle.
FIG. 7A to 7C are views similar to FIGS. 6A to 6C, but showing the adjusting tube in an adjusted position to reduce the shaft's resiliency.

FIG. 6 illustrates how the preferred racket 10 responds to contact with a tennis ball 32 moving toward netting 20. Locking collet 30, adjacent handle 16, permits shaft means 14 to achieve its maximum flexibility so that racket head 12 can achieve its maximum displacement with respect to handle 16.

Position B illustrates the position of head 12 with respect to handle 16 prior to making contact with ball 32. Assuming the user is swinging at the ball in a counter-clockwise motion, the initial contact of the ball with netting 20 causes shaft means 14 to flex in the same direction as the motion of the ball and then to flex in the opposite direction as the ball is returned toward the other player.

FIG. 7 shows the same sequence of motion of racket 10, but with collet 30 adjusted approximately mid-way between handle 16 and head 12. A portion of shaft 14 between head 12 and handle 16 is enclosed by stiff adjusting tube 26, which in turn reduces the resiliency of shaft 14 so that it provides a much stiffer connection between the handle and the head. Accordingly, by changing the position of adjusting tube 26, the user can adjust the overall stiffness of the racket to accomodate his own particular requirements.

Now referring to FIGS. 1, 3, and 4, head 12 comprises a frame member 34 formed of an appropriate plastic material. A pair of parallel metal core members 36 and 38 are embedded in frame member 34 adjacent to its perimeter. A metal anchor 40 receives the ends of core member 36 and 38 as best illustrated in FIG. 4. The anchor also receives the end of shaft means 14 in a position between the ends of the core members. Thus, it can be seen that anchor 40 provides means for connecting shaft means 14 to head 12.

Referring to FIG. 3, core members 36 and 38 each have a circular cross-section. As shown in FIGS. 15 and 16, the core members could have a square cross-section as illustrated at 42 and 44 or they could have a relatively flat cross-section as illustrated at 46 and 48 in FIG. 16. It can be seen that core members 36 and 38 provide strength in a relatively light-weight frame for supporting netting 20.

Figure 9:
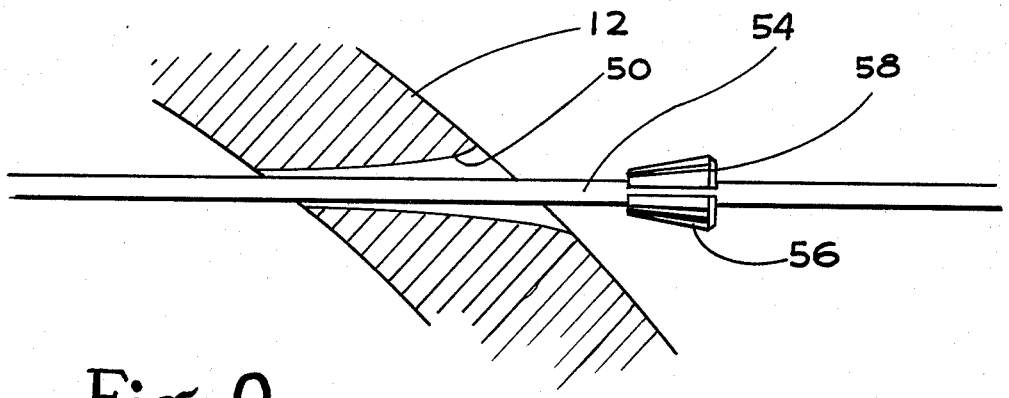
FIGS. 9 and 10 show the manner in which the ferrule is engaged with the string to wedge it in the string-receiving opening.
Figure 8:
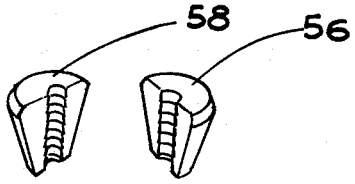
FIG. 8 is a perspective view of a preferred ferrule.
Figure 10:
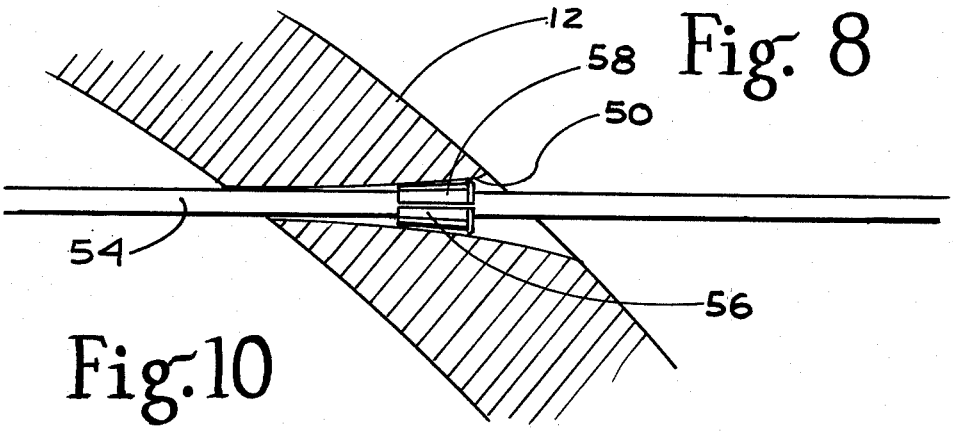
Figure 11:
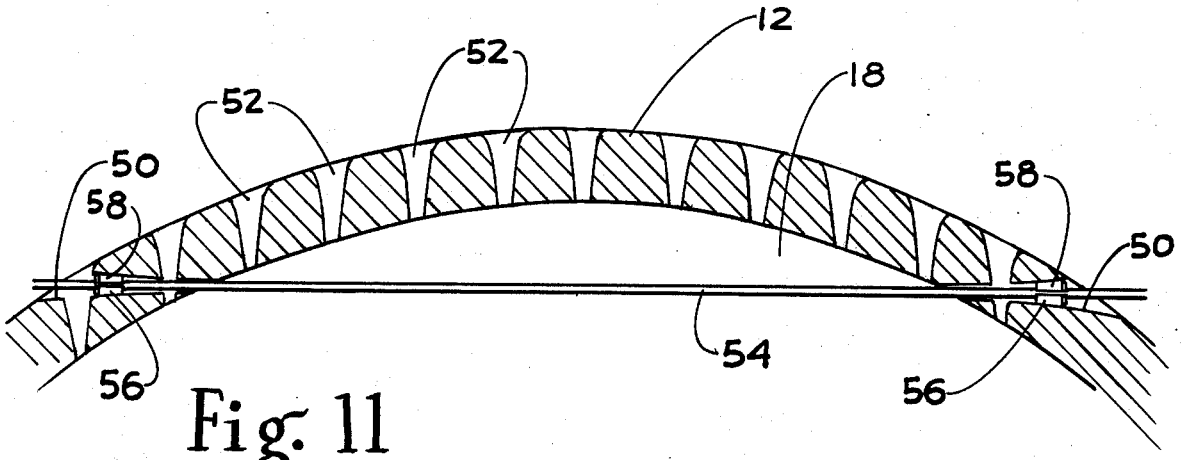
FIG. 11 is a fragmentary view of the racket showing the opposite ends of an individual string connected to the frame.

Now referring to FIGS. 8, 9, and 11, head 12 has a series of regularly spaced openings 50 aligned in pairs on opposite sides of head 12. A second series of openings 52 are formed at right angles to openings 50 in companion pairs on opposite sides of head 12.

Netting 20 is formed of sections of string 54 or an appropriate gut, each of which has its ends connected to head 12 either in a pair of openings 50 or 52. FIG. 11 shows the manner in which a typical string 54 is supported in head 12. As shown in FIG. 3, each of the openings 50 and 52 are formed in the head between cores 36 and 38.

A ferrule, formed of a pair of split halves 56 and 58 as best shown in FIG. 8, is wedged with string 54 in each opening 50. It is to be noted that opening 50 has a longitudinally tapered sidewall to receive the tapered sides of the two ferrule halves so that the string is wedged in the opening to prevent any motion of the string ends relative to frame opening 18.

Figure 12:
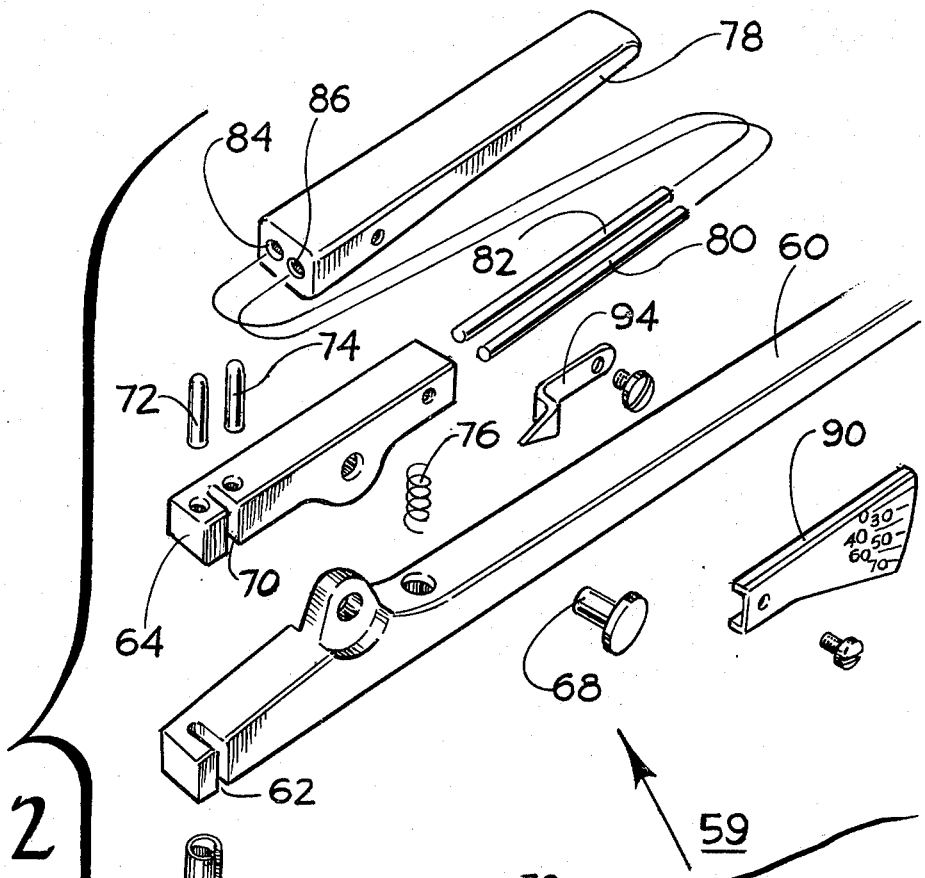
FIG. 12 is an exploded view of the preferred torsion pliers.
Figure 13:
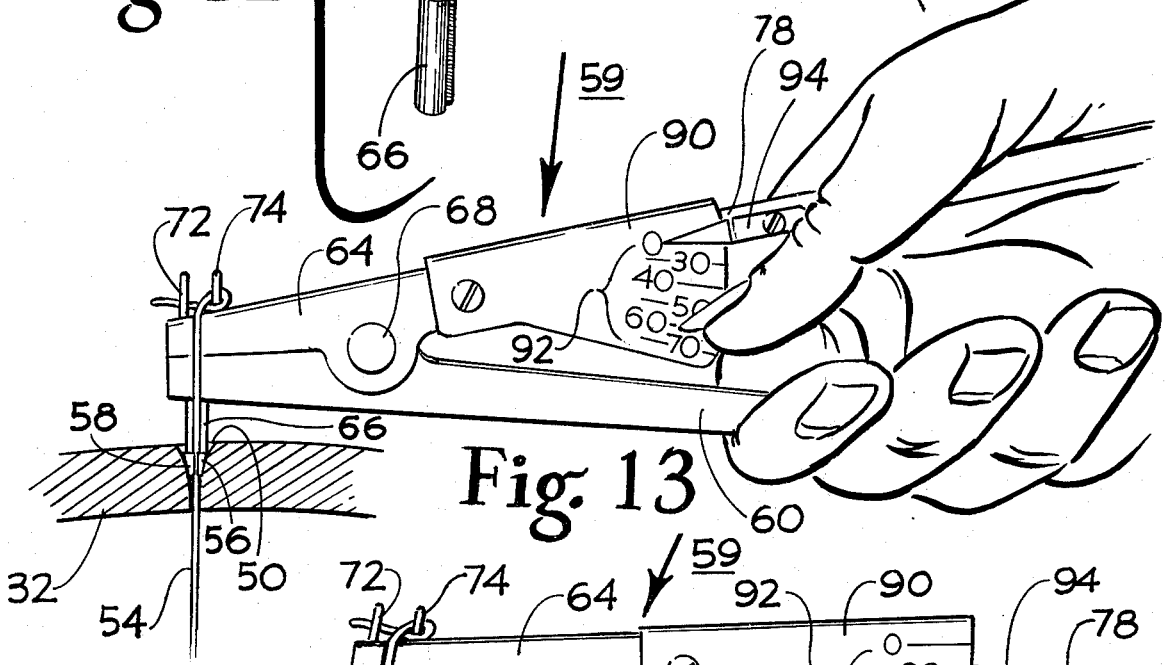
FIG. 13 shows the torsion pliers connected to the string.
Figure 14:
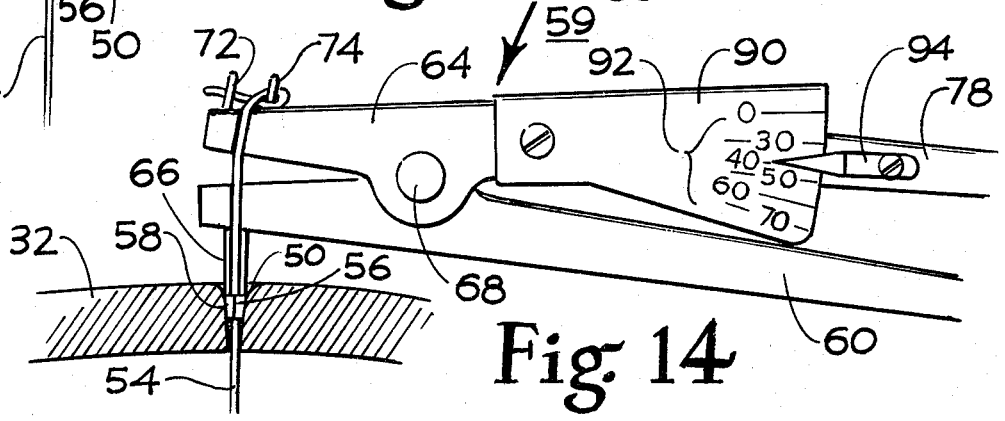
FIG. 14 shows the torsion pliers being manipulated to apply a selected tension on the string.

Preferrably a pair of torsion pliers 59 are employed to provide string 54 with a selected tension as illustrated in FIGS. 12 to 14. Torsion pliers 59 comprise an elongated handle 60 having an opening 62 adjacent to one end adapted to receive string 54, and the upper end of a split ferrule contacting tube 66. An arm 64 is pivotally connected to handle 60 by pin 68. Arm 64 also has an opening 70 aligned with opening 62 in handle 60.

A pair of pins 72 and 74 are mounted on opposite sides of opening 70. Opening 70 is adapted to receive the upper end of string 54 which is then locked around pins 72 and 74.

A spring 76 is mounted between arm 64 and handle 60 so that the string-supporting ends are biased toward one another in the position illustrated in FIG. 13.

A second arm 78 is mounted on the end of arm 64 by a pair of calibrated spring steel members 80 and 82 received in a pair of openings 84 and 86 which face a similar pair of openings (not shown) in the end of arm 64. The arrangement is such that arm 78 is moveable with respect to arm 64 a distance dependent upon the amount of resistance established by string tension opposing the motion of arm 78 toward handle 60.

A scale member 90 is mounted on arm 64. Scale member 90 has a series of indicia generally indicated at 92. A pointer 94 is mounted on arm 78 to overlap scale 90 in positions adjacent indicia 92. The purpose of pointer 94 is to show the relative tension on string 54 as reflected by members 80 and 82.

In use, the operator places split ferrule contacting tube 66 on ferrule halves 56 and 58, as illustrated in FIG. 13, after manually setting the ferrule halves on opposite sides of head 12. String 54 is then tied around pins 72 and 74 with arm 64 in abutment with the outer end of handle 60. In this position, pointer 94 indicates no amount of tension on indicia 92. Ths user then grasps the outer ends of handle 60 and arm 78 and proceeds to close them toward one another which applies a tensile force on string 54 as illustrated in FIG. 14. The number of pounds of tensile force is reflected in the position of pointer 94 with respect to indicia 92. Thus the user can apply a selected number of pounds tensile force on string 54 as he wedges ferrules 56 and 58 into openings 50, locking the string in place.

This procedure is repeated for each individual segment of string 54 completing both sets of holes 50 and 52 until the entire netting has been formed in netting opening 18.

Preferrably ferrules 56 and 58 are made of a metal such as copper. However, they could be made of brass, steel or plastic. Tension pliers 59 could be forgings, stampings, aluminum die castings or the like.

It is apparent that torsion plier means 59 provide a hand-operated device for stringing racket 10 with individual strings 54 to obviate the problems of accidental kinks while stringing, and to allow the user to continue to play if only a single string is broken. In addition, the user can quickly replace an individual string should it be broken.

Having described my invention, I claim:

1. A tennis racket for use in striking a ball, comprising:

a head having a netting opening;

a netting mounted in said netting opening;

a handle;

an elongated resilient shaft having one end connected to the head and its opposite end connected to the handle such that the head is spaced from and moved in a lateral direction with respect to the longitudinal axis of the handle as the netting is being struck by a ball; and an adjustable member movably mounted on the shaft between the head and the handle, and means for locking the adjustable member in a selected longitudinal position along the shaft such that lateral motion of the head with respect to the handle depends upon the position of the adjustable member along the shaft.

2. A tennis racket as defined in claim 1, in which the locking means comprises a collet.

3. A tennis racket as defined in claim 1, in which the head comprises a plastic frame member, and including a pair of spaced elongated cores embedded in the plastic frame member, each core being so formed that its ends are adjacent and parallel to one another and to the ends of the other of the pair of cores, an anchor member having means for receiving the ends of the metal cores, and including means for connecting the shaft to the anchor member such that the shaft is parallel to the ends of the cores.

4. A tennis racket as defined in claim 3, including string-receiving openings on opposite sides of the netting opening, each string-receiving opening being disposed between the elongated metal cores.

5. A tennis racket as defined in claim 1, in which the head has a plurality of string-receiving openings in aligned pairs on opposite sides of the netting opening, a plurality of strings each having its opposite ends disposed on aligned pairs of said string-receiving openings, a ferrule disposed in each of the string-receiving openings and engaging the string therein to prevent its removal therefrom.

6. A tennis racket as defined in claim 5, in which each string-receiving opening and its associated ferrule have complementary tapered portions.

7. In combination:

a tennis racket having a head defining an opening for supporting a netting suited for striking a tennis ball;

the head having a plurality of string-receiving openings in aligned pairs on opposite sides of the head;

a string having a first end disposed in a first opening of an aligned pair of string-receiving openings, and means connecting said first end to the head;

said string-having its opposite end passing through the second opening of said aligned pair of string-receiving openings;

a ferrule disposed in said second opening and engaged with the string, the ferrule being movable toward a position for wedging the string in said second string-receiving opening;

a tube having one end disposed on the ferrule;

plier means including a first plier member mounted on the opposite end of the tube and a second plier member pivotally connected to the first plier member; and means connecting the string to the second plier member such that as it is being moved away from the tube to place the string under tension, the first plier member urges the tube toward the ferrule and its wedging position.

8. A combination as defined in claim 7, in which the second plier member is elongated and resilient so as to be movable with respect to the first plier member according to the tension being placed on a string, and including scale means mounted on the plier means for indicating the string tension according to the position of the second plier member with respect to the first plier member.

* * * * *